US008637438B2

(12) United States Patent
Yamada

(10) Patent No.: US 8,637,438 B2
(45) Date of Patent: Jan. 28, 2014

(54) LUBRICANT COMPOSITION FOR INTERNAL COMBUSTION ENGINE

(75) Inventor: Ryou Yamada, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 845 days.

(21) Appl. No.: 12/093,675

(22) PCT Filed: Nov. 14, 2006

(86) PCT No.: PCT/JP2006/322657

§ 371 (c)(1),
(2), (4) Date: Jul. 3, 2008

(87) PCT Pub. No.: WO2007/058171

PCT Pub. Date: May 24, 2007

(65) Prior Publication Data

US 2009/0181872 A1 Jul. 16, 2009

(30) Foreign Application Priority Data

Nov. 15, 2005 (JP) ..... 2005-330828

(51) Int. Cl.
*C10L 1/16* (2006.01)
*C10G 7/00* (2006.01)
*C10M 159/00* (2006.01)

(52) U.S. Cl.
USPC ..... 508/591; 508/110; 585/1; 585/7; 208/18; 208/19

(58) Field of Classification Search
USPC ..... 508/591, 110; 585/1, 2, 3, 500, 506, 585/507, 508, 600, 601, 13, 6.6, 7; 208/18, 208/19, 113, 143, 18.19
See application file for complete search history.

(56) References Cited

U.S. PATENT DOCUMENTS

| | | | | |
|---|---|---|---|---|
| 4,658,078 | A * | 4/1987 | Slaugh et al. | 585/512 |
| 5,098,551 | A * | 3/1992 | Bertaux et al. | 208/111.3 |
| 5,602,086 | A * | 2/1997 | Le et al. | 508/591 |
| 5,912,212 | A * | 6/1999 | Igarashi et al. | 508/275 |
| 6,191,078 | B1 * | 2/2001 | Shlomo et al. | 508/273 |
| 6,713,438 | B1 * | 3/2004 | Baillargeon et al. | 508/463 |
| 2001/0041818 | A1 * | 11/2001 | Bagheri et al. | 585/521 |
| 2003/0055184 | A1 * | 3/2003 | Song et al. | 526/160 |

FOREIGN PATENT DOCUMENTS

| | | | |
|---|---|---|---|
| EP | 0 613 873 | A2 | 9/1994 |
| EP | 0 613 873 | A3 | 9/1994 |
| EP | 1 103 568 | A1 | 5/2001 |
| EP | 1 950 277 | A1 | 7/2008 |
| JP | 05 163497 | | 6/1993 |
| JP | 06 313183 | | 11/1994 |
| JP | 7 133234 | | 5/1995 |
| JP | 11-293266 | A | 10/1999 |
| JP | 2002 518582 | | 6/2002 |
| JP | 2005 501957 | | 1/2005 |
| WO | 2006 120925 | | 11/2006 |
| WO | WO 2007/011459 | A1 | 1/2007 |

OTHER PUBLICATIONS

Extended European Search Report issued Oct. 22, 2010, in Patent Application No. 06832614.9.
Office Action issued Nov. 6,2012 in Japanese Patent Application No. 2005-330828.

* cited by examiner

*Primary Examiner* — Pamela H Weiss

(74) *Attorney, Agent, or Firm* — Oblon, Spivak, McClelland, Maier & Neustadt, L.L.P.

(57) ABSTRACT

A lubricating oil composition for internal combustion engines comprising a base oil containing at least one component selected from an α-olefin oligomer having 16 to 40 carbon atoms obtained by oligomerizing α-olefin(s) having 2 to 20 carbon atoms using a metallocene catalyst, and the hydrogenated derivative thereof; an α-olefin oligomer having 16 to 40 carbon atoms derived from an α-olefin dimer obtained using a metallocene catalyst, and the hydrogenated derivative thereof; and the like. The lubricating oil composition has an excellent low-temperature fluidity, a low evaporativity, and a good oxidation stability.

19 Claims, No Drawings

LUBRICANT COMPOSITION FOR INTERNAL COMBUSTION ENGINE

TECHNICAL FIELD

The present invention relates to a lubricating oil composition for internal combustion engines, more specifically, relates to a lubricating oil composition for internal combustion engines having an excellent low-temperature fluidity, a low evaporativity, and a good oxidation stability.

BACKGROUND ART

Improving mileage of automobiles is one of the crucial issues for saving energy and also quite important for mankind from the viewpoint of reducing $CO_2$ as a countermeasure against global warming.

As a measure for saving the fuel consumption in the field of engine oil (lubricating oil for internal combustion engines), it has been known that reducing the friction loss caused by engine oil through lowering the viscosity of engine oil is effective. However, lowering the viscosity of engine oil causes problems that anti-wear property required for engine oil is lowered, and that the oil consumption increases mainly due to evaporation loss. For this reason, the present situation is that lowering viscosity is rather difficult to be put into practice.

As a countermeasure against the lowering in anti-wear property associated with lowering the viscosity of base oil, there may be considered a method of blending an additive improving load-bearing ability such as an oiliness improver and an extreme-pressure additive. There have been many proposals such as blending an organomolybdenum compound as a so-called friction-modifying additive (For example, see Patent Documents 1 and 2).

On the other hand, as a countermeasure against the increase in oil consumption due to evaporation loss, there has been known a method of using synthetic oil having a low viscosity and an extremely high viscosity index. However, already developed synthetic oils are expensive, and can not always achieve sufficient performance only by using it. In the case of using mineral base oil, no effective countermeasure has been found yet. Therefore, at present, there is no widely usable fuel-saving engine oil using a low-viscosity base oil.

It is required for engine oils that the low-temperature viscosity is low enough on starting engines and the high-temperature viscosity is sufficiently high during operating engines. In other words, smaller change in viscosity is required between low temperature and high temperature. Multigrade engine oils have emerged to achieve this objective. In the SAE (Society of Automotive Engineers) viscosity classification standard J300 for multigrade engine oils, the low-temperature grading includes 0W, 5W, 10W, 15W, 20W, and 25W, and the high-temperature grading includes 20, 30, 40, 50, and 60. In particular, as a fuel-saving engine oil using a low viscosity base oil, the target of development is an engine oil having a viscosity grade of 5W or less, especially a viscosity grade of 0W. It is expected to reduce oil consumption in using an engine oil having viscosity grade of 0W-20 or less.

In a multigrade engine oil, a viscosity index improver is blended to decrease the viscosity change with temperature. When a multigrade engine oil receives heavy shearing force in engines, simultaneously, the engine oil becomes unable to function as a multigrade oil, and in many cases, the oil consumption increases as well. Therefore, a multigrade engine oil is also required to have good stability against shearing force and stability against shearing force at high temperature.

In addition to the above required properties, an excellent oxidation stability is also required for an engine oil for the view of long operating life.

Patent Document 1: Japanese Patent Application Laid-Open No. H6-313183

Patent Document 2: Japanese Patent Application Laid-Open No. H5-163497

DISCLOSURE OF THE INVENTION

In view of the above circumstances, an object of the present invention is to provide a lubricating oil composition for internal combustion engines having an excellent low-temperature fluidity, low evaporativity, and good oxidation stability.

The present inventor has intensively studied to develop a lubricating oil composition for internal combustion engines having the above-described desirable properties, and as a result, found that the objective can be achieved by using a base oil containing at least one component selected from an α-olefin oligomer prepared using a metallocene catalyst, the number of carbon atoms in the α-olefin oligomer being in a specific range, and the hydrogenated derivative thereof; and an α-olefin oligomer derived from an α-olefin dimer prepared using a metallocene catalyst, the number of carbon atoms in the α-olefin oligomer being in a specific range, and the hydrogenated derivative thereof. The present invention has been completed based on such finding.

That is, the present invention provides:

(1). A lubricating oil composition for internal combustion engines comprising a base oil containing at least one component selected from (A) an α-olefin oligomer having 16 to 40 carbon atoms obtained by oligomerizing α-olefins, having 2 to 20 carbon atoms, using a metallocene catalyst;

(B) a hydrogenated derivative of the α-olefin oligomer (A);

(C) an α-olefin oligomer having 16 to 40 carbon atoms obtained by dimerizing vinylidene bond-containing α-olefin dimers using an acid catalyst, wherein the vinylidene bond-containing α-olefin dimers are prepared by dimerizing α-olefins having 2 to 20 carbon atoms using a metallocene catalyst;

(D) a hydrogenated derivative of the α-olefin oligomer (C);

(E) an α-olefin oligomer having 16 to 40 carbon atoms obtained by adding, using an acid catalyst, an α-olefin having 6 to 8 carbon atoms to a vinylidene bond-containing α-olefin dimer obtained by dimerizing α-olefins having 2 to 20 carbon atoms, using a metallocene catalyst; and (F) a hydrogenated derivative of the α-olefin oligomer (E).

(2). The lubricating oil composition for internal combustion engines described in (1), wherein the α-olefin oligomer of the component (A) has the structure represented by the general formula (I):

[Formula 1]

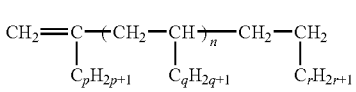

(I)

(In the formula, p, q, and r represent each independently an integer of 0 to 18; n is an integer of 0 to 8; when n is 2 or more, the values of q in individual repeating units may be the same or different; and the value of p+n×(2+q)+r is 12 to 36.), (3) a lubricating oil composition for internal combustion engines as described in (1), wherein the hydrogenated α-olefin oligomer of the component (B) has the structure represented by the general formula (II):

[Formula 2]

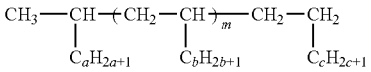

(II)

(In the formula, a, b, and c represent each independently an integer of 0 to 18; m represents an integer of 0 to 8; when m is 2 or more, the values of a in individual repeating units may be the same or different; and the value of a+m×(2+b)+c is 12 to 36.)

(4) a lubricating oil composition for internal combustion engines as described in (1), wherein the base oil contains 10 to 100% by mass of at least one component selected from components (A) to (F), and (5) a lubricating oil composition for internal combustion engines as described in (1), comprising at least one additive selected from an extreme-pressure additive, an oiliness improver, an antioxidant, a rust inhibitor, a metal deactivator, a detergent-dispersant, a viscosity index improver, a pour-point depressant, and a defoaming agent.

According to the present invention, a lubricating oil composition for internal combustion engines having an excellent low-temperature fluidity, low evaporativity, and good oxidation stability can be provided.

BEST MODE FOR CARRYING OUT THE INVENTION

In the lubricating oil composition for internal combustion engines of the present invention, the base oil contains at least one component selected from α-olefin oligomers and their hydrogenated derivatives (A) to (F) below in an amount of preferably 10 to 100% by mass, more preferably 20 to 100% by mass, and still more preferably 25 to 100% by mass. When the base oil contains 10% by mass or more of the α-olefin oligomer or its hydrogenated derivative, a lubrication oil composition having an excellent low-temperature fluidity, a low evaporativity, and an improved oxidation stability can be obtained.

[(A) α-Olefin Oligomer]

The α-olefin oligomer of the component (A) used for the base oil in the present invention is an α-olefin oligomer having 16 to 40 carbon atoms which is obtained by oligomerization of an α-olefin having 2 to 20 carbon atoms using a metallocene catalyst. When the number of carbon atoms in the α-olefin oligomer is in the range of 16 to 40, a base oil having an excellent low-temperature fluidity, a low evaporativity, and an oxidation stability can be obtained, whereby a lubricating oil composition using the base oil achieves the objective of the present invention. The preferable number of carbon atoms in the α-olefin oligomer ranges from 20 to 34.

As the starting α-olefin having 2 to 20 carbon atoms, there may be mentioned ethylene, propylene, 1-butene, 1-pentene, 1-hexene, 1-heptene, 1-octene, 1-nonene, 1-decene, 1-undecene, 1-dodecene, 1-tridecene, 1-tetradecene, 1-pentadecene, 1-hexadecene, 1-heptadecene, 1-octadecene, 1-nonadecene, and 1-eicocene. The α-olefin may be linear or branched. In the present invention, these α-olefins may be used alone or in combination of two or more.

As the metallocene catalyst used for oligomerization of the α-olefin in the present invention, there may be mentioned a conventional catalyst, for example, a combination of (a) a metallocene complex containing an element belonging to Group 4 in the periodic table, (b) (b-1) a compound capable of reacting with metallocene complex (a) or its derivative to form an ionic complex and/or (b-2) an aluminoxane, and optionally (c) an organoaluminum compound.

As the metallocene complex of the component (a) containing an element belonging to Group 4 in the periodic table, there may be used a complex containing titanium, zirconium, or hafnium. A complex having zirconium containing conjugated carbon five-membered ring is preferred.

Here, the complex having a conjugated carbon five-membered ring generally includes a complex having a substituted or unsubstituted cyclopentadienyl ligand.

The metallocene complex of the catalyst component (a) includes conventional compounds, for example, bis(n-octadecylcyclopentadienyl)zirconium dichloride, bis(trimethylsilylcyclopentadienyl)zirconium dichloride, bis(tetrahydroindenyl)zirconium dichloride, bis[(t-butyldimethylsilyl)cyclopentadienyl]zirconium dichloride, bis(di-t-butylcyclopentadienyl)zirconium dichloride, ethylidenebis(indenyl)zirconium dichloride, biscyclopentadienylzirconium dichloride, ethylidenebis(tetrahydroindenyl)zirconium dichloride, bis[3,3-(2-methylbenzindenyl)](dimethylsilanediyl)zirconium dichloride, (1,2'-dimethylsilylene)(2,1'-dimethylsilylene)bis(3-trimethylsilylmethylidenyl)zirconium dichloride, and the like.

These metallocene complexes may be used alone or in combination of two or more.

As compound (b-1), that is, the compound capable of reacting with the metallocene complex or its derivative to form an ionic complex, there may be mentioned, for example, a borate compound such as dimethylanilinium tetrakis(pentafluorophenyl)borate and triphenylcarbenium tetrakis(pentafluorophenyl)borate. These compounds may be used alone or in combination of two or more.

The aluminoxane of the compound (b-2) includes, for example, chain aluminoxanes such as methylaluminoxane, ethylalununoxane, butylaluminoxane, and isobutylaluminoxane, and cyclic aluminoxanes. These aluminoxanes may be used alone or in combination of two or more.

As catalyst component (b) in the present invention, there may be used one or more kinds of compound (b-1), one or more kinds of compound (b-2), or a combination of one or more kinds of compound (b-1) and one or more kinds of compound (b-2).

When compound (b-1) is used as catalyst component (b), the molar ratio of catalyst component (a) to catalyst component (b) is preferably 10:1 to 1:100, and more preferably 2:1 to 1:10. The ratio beyond the above range is not practical, since catalyst cost per unit mass of polymer becomes high. When compound (b-2) is used, the molar ratio is preferably 1:1 to 1:1000000, and more preferably 1:10 to 1:10000. The ratio beyond this range is not practical, since catalyst cost per unit mass of polymer becomes high.

As the organoaluminum compound optionally used as catalyst component (c), there may be mentioned, for example, trimethylaluminum, triethylaluminum, triisopropylaluminum, triisobutylaluminum, dimethylaluminum chloride, diethylaluminum chloride, methylaluminum dichloride, ethylaluminum dichloride, dimethylaluminum fluoride, diisobutylaluminum hydride, diethylaluminum hydride, ethylaluminum sesquichloride, and the like.

These organoaluminum compounds may be used alone or in combination of two or more.

The molar ratio of catalyst component (a) to catalyst component (c) is preferably 1:1 to 1:10000, more preferably 1:5 to 1:2000, and still more preferably 1:10 to 1:1000. The use of catalyst component (c) can increase the catalytic activity for polymerization per unit amount of the transition metal. However, use of too excessive catalyst component (c) is undesired, since the organoaluminum compound is wasted and also remained in the polymer in a large amount.

When the catalyst is prepared using catalyst component (a) and catalyst component (b), it is desirable to bring these components in contact with each other under an atmosphere of inert gas such as nitrogen.

When the catalyst is prepared using catalyst component (a), catalyst component (b), and organoaluminum compound (c), catalyst component (b) and organoaluminum compound (c) may be brought in contact to each other beforehand. Alternatively, contacting of components (a), (b), and (c) in the presence of an α-olefin also yields a catalyst having a sufficiently high activity.

The catalyst may be used after prepared in advance in a catalyst preparation tank, or the catalyst may be prepared in the oligomerization step.

Oligomerization of the α-olefin may be carried out either in batch process or continuous process. Solvent is not always necessary for the oligomerization. The oligomerization can be carried out in suspension, liquid monomer, or inert solvent. When the oligomerization is carried out in solvent, a liquid organic hydrocarbon, such as benzene, ethylbenzene, and toluene, is used. The oligomerization is preferably carried out in a reaction mixture in which a liquid monomer is present in excess.

As the conditions for oligomerization, the temperature is approximately in the range of 15 to 100° C. and the pressure is atmospheric pressure to approximately 0.2 MPa. As for the ratio of the catalyst to the α-olefin, the molar ratio of α-olefin/metallocene complex of the component (A) is generally 1000 to $10^6$, and preferably 2000 to $10^5$. The typical reaction time is approximately in the range of 10 min to 48 hr.

As the work-up procedures after oligomerization, the oligomerization is terminated by conventional deactivation treatment, i.e. addition of water or alcohol to the reaction system, and then deashing treatment of the catalyst with an alkaline aqueous solution or an alcoholic alkaline solution is carried out. Subsequently the organic layer is subjected to neutralization, washing, distillation, and other operations. To remove unreacted α-olefin and olefin isomers generated as byproducts during the oligomerization, stripping is carried out, and the α-olefin oligomer having the desired polymerization degree is isolated.

The α-olefin oligomer produced with the metallocene catalyst in this way has a double bond, and the content of terminal vinylidene bond is particularly high.

The α-olefin oligomer generally has the structure with an terminal vinylidene bond represented by the general formula (I).

[Formula 3]

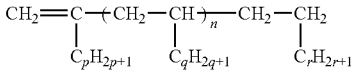

(I)

In formula (I), p, q, and r represent each independently an integer of 0 to 18 and n represents an integer of 0 to 8. When n is 2 or more, the values of q in the individual repeating units may be the same or different. The value of p+n×(2+q)+r is 12 to 36.

[(B) Hydrogenated α-Olefin Oligomer]

The hydrogenated α-olefin oligomer of the component (B) used for the base oil in the present invention is the hydrogenated derivative of the α-olefin oligomer of the component (A). The hydrogenated α-olefin oligomer may be produced by hydrogenating the α-olefin oligomer having the desired polymerization degree, and being separated as described above, by a conventional method. Alternatively, it may be produced by a method where the reaction mixture obtained in the above oligomerization is subjected to deashing, neutralizing, and washing treatment, and the α-olefin oligomer, without isolation by distillation, is hydrogenated, followed by isolation of the hydrogenated α-olefin oligomer having the desired polymerization degree by distillation.

The hydrogenation of the α-olefin oligomer is carried out with a conventional hydrogenation catalyst, for example, a Ni- or Co-based catalyst and a precious metal catalyst such as Pd and Pt, specifically, Ni catalyst carried on diatomite, trisacetylacetonatocobalt/organoaluminum, palladium carried on activated charcoal, and platinum carried on alumina.

For the hydrogenation conditions, the temperature range is generally from 150 to 200° C. for Ni-based catalysts, generally from 50 to 150° C. for precious metal catalysts such as Pd and Pt, and generally from 20 to 100° C. for homogeneous catalysts such as trisacetylacetonatocobalt/organoaluminum; and the hydrogen pressure is atmospheric pressure to approximately 20 MPa.

When the reaction temperature is in the above range for each catalyst, an appropriate reaction rate can be attained, and formation of isomers of the oligomer having same polymerization degree can be inhibited.

The hydrogenated α-olefin oligomer thus obtained generally has a structure represented by the general formula (II).

[Formula 4]

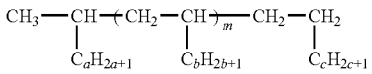

(II)

In the above formula (II), a, b, c, and m are the same as p, q, r, and n in the general formula (I), respectively.

The hydrogenated α-olefin oligomer is more suitable than the α-olefin oligomer having a terminal vinylidene bond of the component (A) in terms of an oxidation stability.

[(C) α-Olefin Oligomer]

The α-olefin oligomer of the component (C) used for the base oil in the present invention is an α-olefin oligomer having 16 to 40 carbon atoms obtained by dimerizing vinylidene bond-containing α-olefin dimers using an acid catalyst, wherein the vinylidene bond-containing α-olefin dimers are prepared by dimerizing α-olefins having 2 to 20 carbon atoms using a metallocene catalyst.

The starting α-olefin having 2 to 20 carbon atoms is as explained for component (A), and such α-olefins may be used in combination.

Details of the dimerization of the α-olefin, such as the metallocene catalyst, dimerization conditions, and the work-up procedures, are as explained for the α-olefin oligomer of the component (A).

In the present invention, the above α-olefin dimer(s) obtained using a metallocene catalyst (hereinafter, may be called vinylidene olefin) is(are) further dimerized using an acid catalyst. Here, the reaction may be carried out either using a single vinylidene olefin or using different vinylidene olefins.

The acid catalyst usable for the dimerization includes a Lewis acid catalyst, a solid acid catalyst, and the like. In terms of ease in work-up, a solid acid catalyst is preferred.

The solid acid catalyst includes acidic zeolite, acidic zeolite molecular sieve, acid-treated clay mineral, acid-treated porous desiccant, ion exchange resin, and the like. Specifically, the solid acid catalyst includes an acidic zeolite such as HY-zeolite, an acidic zeolite molecular sieve having a pore diameter of approximately 0.5 to 2 nm, silica-alumina, silica-magnesia, a clay mineral such as montmorillonite or haloisite treated with an acid such as sulfuric acid, a porous desiccant such as silica gel or alumina gel on which hydrochloric acid, sulfuric acid, phosphoric acid, an organic acid, $BF_3$ or the like is adsorbed, and ion exchange resins such as sulfonated divinylbenzene/styrene copolymer.

The solid acid catalyst is generally added in an amount of 0.05 to 20 parts by mass with respect to 100 parts by mass of the vinylidene olefin(s) to be reacted. Addition of more than 20 parts by mass of the solid acid catalyst is not only wasteful but also likely to promote side reactions, possibly increasing the viscosity of reaction solution or decreasing the yield. When the amount of solid acid catalyst is less than 0.05 part by mass, the reaction efficiency decreases and longer reaction time is required.

The more preferable amount depends on the acidity of the solid acid catalyst: for example, for sulfuric acid-treated montmorillonite-type clay mineral, it is 3 to 15 parts by mass with respect to 100 parts by mass of the vinylidene olefin while for sulfonated divinylbenzene/styrene copolymer ion exchange resin, it is 1 to 5 parts by mass. In accordance with reaction conditions, two or more of these solid acid catalysts may be used in combination.

The reaction temperature is generally 50 to 150° C., and preferably 70 to 120° C. for improving the reactivity and selectivity. The reaction pressure is selected in the range of atmospheric pressure to approximately 1 MPa, although the pressure less affects the reaction.

The above dimerization of the vinylidene olefin(s) yields the α-olefin oligomer of the component (C), which is a vinylidene olefin dimer having 16 to 40 carbon atoms represented by the general formula (III) or (IV).

[Formula 5]

(III)

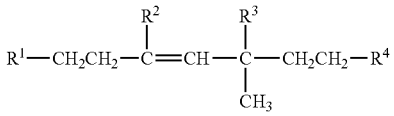

(IV)

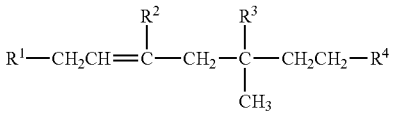

(In the formulae, $R^1$ to $R^4$ represent each independently a hydrogen atom or a linear or branched alkyl group having 1 to 18 carbon atoms; and the total number of carbon atoms in $R^1$ to $R^4$ is 8 to 32.)

The reaction solution of dimerization contains unreacted vinylidene olefin(s) and vinylidene olefin trimers other than the vinylidene olefin dimer(s). Therefore, after the solid acid catalyst is filtered off from the dimerization solution, the vinylidene olefin dimer represented by general formula (III) or (IV) may be isolated by distillation, if necessary.

[(D) Hydrogenated α-Olefin Oligomer]

The hydrogenated α-olefin oligomer of the component (D) used for the base oil can be obtained by hydrogenating the reaction solution containing the vinylidene olefin dimer(s), which is obtained after removal of the solid acid catalyst as described above, or hydrogenating the vinylidene olefin dimer(s) isolated from the reaction solution by distillation. When the reaction solution is used in the hydrogenation, the hydrogenated vinylidene olefin dimer may be isolated by distillation, if necessary.

Details of the hydrogenation, such as the catalyst and reaction conditions, are as explained for the hydrogenated α-olefin oligomer of the component (B).

In this way, the hydrogenated α-olefin oligomer of the component (D) can be obtained, which is a hydrogenated vinylidene olefin dimer having 16 to 40 carbon atoms represented by the general formula (V).

[Formula 6]

(V)

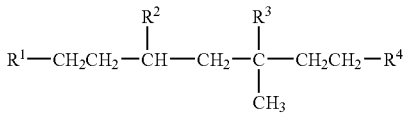

(In the formula, $R^1$ to $R^4$ are the same as those described above.)

The hydrogenated α-olefin oligomer of the component (D) is more suitable than the α-olefin oligomer of the component (C) in terms of an oxidation stability.

[(E) α-Olefin Oligomer]

The α-olefin oligomer of the component (E) used for the base oil is an α-olefin oligomer having 16 to 40 carbon atoms obtained by adding an α-olefin having 6 to 8 carbon atoms, using an acid catalyst, to a vinylidene bond-containing α-olefin dimer obtained by dimerizing α-olefins, having 2 to 20 carbon atoms, using a metallocene catalyst.

The starting α-olefin having 2 to 20 carbon atoms is as explained for component (A). The number of carbon atoms in the α-olefin oligomer is preferably in the range of 20 to 34. In the present invention, the α-olefins may be used alone or in combination of two or more.

Details of the dimerization of the α-olefin, such as the metallocene catalyst, dimerization conditions, and work-up procedures, are as explained for the α-olefin oligomer of the component (A).

In the present invention, an α-olefin having 6 to 8 carbon atoms is added, using an acid catalyst, to the above α-olefin dimer (vinylidene olefin) obtained using a metallocene catalyst.

In this reaction, the type and amount of acid catalyst to be used and the reaction conditions are solar to those in the dimerization of vinylidene olefin(s) in the case of the α-olefin oligomer of the component (C). The α-olefin having 6 to 8 carbon atoms includes 1-hexene, 1-heptene, and 1-octene. These α-olefins may be linear or branched. Further, in the present invention, these α-olefins may be used alone or in combination of two or more.

This reaction yields an α-olefin oligomer having 16 to 40 carbon atoms of the component (E) represented by general formula (VI).

[Formula 7]

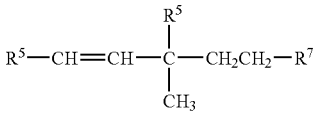

(VI)

(In the formula, $R^5$ represents an alkyl group having 4 to 6 carbon atoms; $R^6$ and $R^7$ represent each independently a hydrogen atom or an alkyl group having 1 to 18 carbon atoms; and the total number of carbon atoms in $R^5$ to $R^7$ is 10 to 34.)

In general formula (VI), the alkyl group having 4 to 6 carbon atoms represented by $R^5$ may be linear or branched, and the alkyl group having 1 to 18 carbon atoms represented by $R^6$ or $R^7$ may be linear chain or branched.

After the reaction, the solid acid catalyst is filtered off from the reaction solution, and the α-olefin oligomer represented by general formula (VI) may be isolated by distillation, if necessary.

[(F) Hydrogenated α-Olefin Oligomer]

The hydrogenated α-olefin oligomer of the component (F) used for the base oil in the present invention can be obtained by the hydrogenating reaction solution containing the α-olefin oligomer of the general formula (VI), which is obtained after removal of the solid acid catalyst as described above, or hydrogenating the α-olefin oligomer isolated from the reaction solution by distillation. When the reaction solution is used in the hydrogenation, the hydrogenated α-olefin oligomer may be isolated by distillation, if necessary.

Details of the hydrogenation, such as the catalyst and reaction conditions, are as explained for the hydrogenated α-olefin oligomer of the component (B).

In this way, the hydrogenated α-olefin oligomer having 16 to 40 carbon atoms of the component (F) represented by general formula (VII) can be obtained.

[Formula 8]

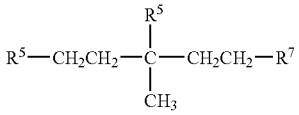

(VII)

(In the formula, $R^5$ to $R^7$ are the same as those described above.)

The hydrogenated α-olefin oligomer of the component (F) is more suitable than the α-olefin oligomer of the component (E) in terms of oxidation stability.

The base oil used in the lubricating oil composition for internal combustion engines of the present invention may contain (an)other base oil(s) in an amount of 90% by mass or less, preferably 80% by mass or less, and more preferably 75% by mass or less, other than the α-olefin oligomers and hydrogenated derivatives thereof of the components (A) to (F).

As the other base oils, there may be used mineral base oils and/or synthetic base oils generally used for engine oils.

The mineral base oils include, for example, a base oil obtained by a method in which crude oil is distilled under atmospheric pressure to obtain residue, the residue is distilled under vacuum to collect a lubricating oil fraction, and this lubricating oil is refined by one or more processes of solvent deasphalting, solvent extraction, hydrocracking, solvent dewaxing, hydrotreating, and others; a base oil produced by isomerization of mineral oil wax or wax produced by Fischer-Tropsch process (gas-to-liquid wax); and the like.

These mineral base oils preferably have a viscosity index of 90 or more, more preferably 100 or more, and still more preferably 110 or more. The mineral base oil with a viscosity index of 90 or more has an effect of facilitating the objective of the present invention, that is, providing an oil composition with a reduced low-temperature viscosity and an increased high-temperature viscosity.

In these mineral base oils, the aromatic content (% $C_A$) is preferably 3 or less, more preferably 2 or less, and still more preferably 1 or less; and the sulfur content is preferably 100 ppm by mass or less, and more preferably 50 ppm by mass or less. When the % $C_A$ value is 3 or less and the sulfur content is 100 ppm by mass ore less, the oxidation stability of the composition can be kept good.

On the other hand, examples of the synthetic base oils include an α-olefin oligomer obtained by conventional methods (using $BF_3$ catalyst, Ziegler catalyst, etc.) and a hydrogenated derivative thereof, diesters such as di-2-ethylhexyl adipate and di-2-ethylhexyl cebacate, esterified polyols such as trimethylolpropane caprate and pentaerythritol 2-ethylhexanoate, aromatic synthetic oils such as alkylbenzene and alkylnaphthalene, polyalkylene glycols, and mixtures thereof.

In the present invention, as the other base oils, there may be used the mineral base oils, the synthetic base oils, any mixture of two or more selected therefrom, and the like. The example includes one or more kinds of the mineral base oils, one or more kinds of the synthetic base oils, a mixed oil of one or more kinds of the mineral base oils and one or more kinds of the synthetic base oils, and the like.

The lubricating oil composition for internal combustion engines of the present invention, as long as the objective of the present invention is not impaired, may optionally contain at least one kind of additive selected from various additives conventionally used in lubricating oil compositions for internal combustion engines, such as an extreme-pressure additive, an oiliness improver, an antioxidant, a corrosion inhibitor, a metal deactivator, a detergent-dispersant, a viscosity index improver, a pour-point depressant, and a defoaming agent.

Preferred compounds as the above extreme-pressure additive includes esters of phosphoric or phosphorous acid such as phosphates, acidic phosphates, phosphites, and acidic phosphites, amine salts of these esters, sulfur-containing extreme-pressure additives, and the like.

The phosphates include, for example, a triaryl phosphate, a trialkyl phosphate, a tri(alkylaryl)phosphate, a triaralkyl phosphate, and a trialkenyl phosphate; specifically, triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, di(ethylphenyl)phenyl phosphate, propylphenyl diphenyl phosphate, di(propylphenyl)phenyl phosphate, triethylphenyl phosphate, tripropylphenyl phosphate, butylphenyl diphenyl phosphate, di(butylphenyl)phenyl phosphate, tributylphenyl phosphate, trihexyl phosphate, tri(2-ethylhexyl)phosphate, tridecyl phosphate, trilauryl phosphate, triyristyl phosphate, tripalmityl phosphate, tristearyl phosphate, trioleyl phosphate, and the like.

The acidic phosphates include, for example, 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate, isostearyl acid phosphate, and the like.

The phosphates, include for example, triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, trioleyl phosphite, and the like.

The acidic phosphites include, for example, dibutyl hydrogenphosphite, dilauryl hydrogenphosphite, dioleyl hydrogenphosphite, distearyl hydrogenphosphite, diphenyl hydrogenphosphate, and the like. Among these esters of phosphoric or phosphorous acid, tricresyl phosphate and triphenyl phosphate are preferable.

The amines which form amine salts with these phosphate esters include mono-substituted amines such as butylamine, pentylamine, hexylamine, cyclohexylamine, octylamine, laurylamine, stearylamine, oleylamine, and benzylamine; di-substituted amines such as dibutylamine, dipentylamine, dihexylamine, dicyclohexylamine, dioctylamine, dilaurylamine, distearylamine, dioleylamine, dibenzylamine, stearylmonoethanolamine, decylmonoethanolamine, hexylmonopropanoiamine, benzylmonoethanolamine, phenylmonoethanolamine, and tolylmonopropanolamine; and tri-substituted amines such as tributylamine, tripentylamine, trihexylamine, tricyclohexylamine, trioctylamine, trilaurylamine, tristearylamine, trioleylainine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryldiethanol amine, octyldipropanolamine, butyldiethanolamine, benzyldiethanolamine, phenyldiethanolamine, tolyldipropanolamine, xylyldiethanolamine, triethanolae, and tripropanolamine.

The sulfur-containing extreme-pressure additive may be any compound having (a) sulfur atom(s) in the molecule that is soluble or uniformly dispersible in the lubricating base oil and provides an excellent extreme-pressure property or friction characteristics. Such compounds include, for example, sulfurized fats/oils, sulfurized fatty acids, sulfurized esters, sulfurized olefins, dihydrocarbyl polysulfides, thiadiazoles, esters of thiophosphoric or thiophosphorous acid (thiophosphites and thiophosphates), alkylthiocarbamoyl-containing compounds, thiocarbamates, thioterpenes, and dialkyl thiodipropionates. The sulfurized fat/oil is obtained by reacting a fat or oil (lard oil, whale oil, vegetable oil, fish oil, etc.) with sulfur or a sulfur-containing compound. Generally, the sulfur content of the sulfurized fat/oil is preferably, but not limited to, 5 to 30% by mass. Specific examples of the sulfurized fat/oil include sulfurized lard, sulfurized rapeseed oil, sulfurized castor oil, sulfurized soybean oil, sulfurized rice bran oil, and the like. Examples of the sulfurized fatty acids include sulfurized oleic acid and the like. Examples of the sulfurized esters include sulfurized methyl oleate, sulfurized rise bran fatty acid octyl ester, and the like.

Preferred examples of the dihydrocarbyl polysulfides include dibenzyl polysulfide, any isomers of dinonyl polysulfide, any isomers of didodecyl polysulfide, any isomers of dibutyl polysulfide, any isomers of dioctyl polysulfide, diphenyl polysulfide, dicyclohexyl polysulfide, and the like.

Preferred examples of the thiadiazoles include 2,5-bis(n-hexyldithio)-1,3,4-thiadiazole, 2,5-bis(n-octyldithio)-1,3,4-thiadiazole, 2,5-bis(n-nonyldithio)-1,3,4-thiadiazole, 2,5-bis(1,1,3,3-tetramethylbutyldithio)-1,3,4-thiadiazole, 3,5-bis(n-hexyldithio)-1,2,4-thiadiazole, 3,6-bis(n-octyldithio)-1,2,4-thiadiazole, 3,5-bis(n-nonyldithio)-1,2,4-thiadiazole, 3,5-bis(1,1,3,3-tetramethylbutylthio)-1,2,4-thiadiazole, 4,5-bis(n-octyldithio)-1,2,3-thiadiazole, 4,5-bis(n-nonyldithio)-1,2,3-thiadiazole, 4,5-bis(1,1,3,3-tetramethylbutyldithio)-1,2,3-thiadiazole, and the like.

The esters of thiophosphoric or thiophosphorous acid include alkyl trithiophosphite, aryl thiophosphate, alkylaryl thiophosphate, zinc dialkyl dithiophosphate, and the like. In particular, lauryl trithiophosphite, triphenyl thiophosphate, and zinc dilauryl dithiophosphate are preferable.

Preferred examples of the alkylthiocarbamoyl compounds include bis(dimethylthiocarbamoyl) monosulfide, bis(dibutylthiocarbamoyl) monosulfide, bis(dimethylthiocarbamoyl) disulfide, bis(dibutylthiocarbamoyl) disulfide, bis(diamylthiocarbamoyl) disulfide, bis(dioctylthiocarbamoyl) disulfide, and the like.

The thiocarbamates include, for example, zinc dialkyl dithiocarbamate. The thioterpenes include, for example, a reaction product of phosphorous pentasulfide and pinene. The dialkyl thiodipropionates include, for example, dilauryl thiodipropionate, distearyl thiodipropionate, and the like. Among these, thiadiazoles and benzyl sulfide are preferable in terms of the extreme-pressure property, friction characteristics, and thermal oxidation stability.

These extreme-pressure additives may be used alone or in combination of two or more. The content thereof is selected from the range of generally 0.01 to 10% by mass, preferably 0.05 to 5% by mass, on a basis of the total amount of the lubricating oil composition in terms of balance between effect and cost or the like.

Examples of the oiliness improver include aliphatic saturated or unsaturated monocarboxylic acids such as stearic acid and oleic acid, polyfatty acids such as dimer acid and hydrogenated dimer acid, hydroxyfatty acids such as ricinoleic acid and 12-hydroxystearic acid, aliphatic saturated or unsaturated monoalcohols such as lauryl alcohol and oleyl alcohol, aliphatic saturated or unsaturated monoamines such as stearylamine and oleylamine, aliphatic saturated or unsaturated monocarboxamides such as laurylamide and oleylamide, and the like.

These compounds may be used alone or in combination of two or more. The content thereof is selected from the range of generally 0.01 to 10% by mass, preferably 0.1 to 5% by mass, on the basis of a total amount of the lubricating oil composition.

Examples of the antioxidants include amine-type antioxidants, phenol-type antioxidants, sulfur-containing antioxidants, and the like.

The amine-type antioxidants include, for example, monoalkyldiphenylamines such as monooctyldiphenylamine and monononyldiphenylamine; dialkyldiphenylamines such as 4,4'-dibutyldiphenylamine, 4,4'-dipentyldipbenzylamine, 4,4'-dihexyldiphenylamine, 4,4'-diheptyldiphenylamine, 4,4'-dioctyldiphenylamine, and 4,4'-dinonyldiphenylamine; polyalkyldiphenylamines such as tetrabutyldiphenylamine, tetrahexyldiphenylamine, tetraoctyldiphenylamine, and tetranonyldiphenylamine; and naphthylamines such as α-naphthylamine, phenyl-α-naphthylamine, butylphenyl-naphthylamine, pentylphenyl-α-naphthylamine, hexylphenyl-α-naphthylamine, heptylphenyl-α-naphthylamine, octylphenyl-α-naphthylamine, and nonylphenyl-α-naphthylamine. Among them, dialkyldiphenylamines are preferable.

The phenol-type antioxidants include, for example, monophenols such as 2,6-di-tert-butyl-4-methylphenol and 2,6-di-tert-butyl-4-ethylphenol, and diphenols such as 4,4'-methylenebis(2,6-di-tert-butylphenol) and 2,2'-methylenebis (4-ethyl-6-tert-butylphenol).

The sulfur-containing antioxidants include, for example, phenothiazine, pentaerythritol tetrakis(3-laurylthiopropionate), bis(3,5-di-tert-butyl-4-hydroxybenzyl) sulfide, thiodiethylenebis[3-(3,5-di-tert-butyl-4-hydroxyphenyl)] propionate, 2,6-di-tert-butyl-4-[4,6-bis(octylthio)-1,3,5-triazin-2-ylmethylamino]phenol, and the like.

These antioxidants may be used alone or in combination of two or more. The content thereof is selected from the range of generally 0.01 to 10% by mass, preferably 0.03 to 5% by mass, on a basis of the total amount of the lubricating oil composition.

Compounds usable as the rust inhibitor include, for example, alkyl- or alkenyl-succinic acid derivatives such as dodecenylsuccinic acid half ester, octadecenylsuccinic anhydride, and dodecenylsuccinamide; polyol partial esters such as sorbitan monooleate, glycerin monooleate, and pentaerythritol monooleate; amines such as rosin amine and N-oleylsarcosine; dialkyl phosphite amine salts. These compounds may be used alone or in combination of two or more.

The content of the rust inhibitor(s) ranges preferably from 0.01 to 5% by mass, particularly preferably from 0.05 to 2% by mass, on a basis of the total amount of the lubricating oil composition.

Compounds usable as the metal deactivator include, for example, benzotriazoles, thiadiazoles, gallic acid esters, and the like.

The content of metal deactivator ranges preferably from 0.01 to 0.4% by mass, particularly preferably from 0.01 to 0.2% by mass, on a basis of the total amount of the lubricating oil composition.

The detergent-dispersant includes metallic detergents such as an alkaline earth metal sulfonate, an alkaline earth metal phenate, an alkaline earth metal salicylate, and an alkaline earth metal phosphonate; and ashless dispersants such as an alkenylsuccinimide, benzylamine, an alkylpolyamine, and alkenylsuccinic acid ester. These detergent-dispersant may be used alone or in combination of two or more. The content thereof is generally 0.1 to 30% by mass, preferably 0.5 to 10% by mass, on a basis of the total amount of the lubricating oil composition.

The viscosity index improver includes, for example, polymethacrylate, dispersed polymethacrylate, olefin copolymer (for example, ethylene-propylene copolymer, etc.), dispersed olefin copolymer, styrene copolymer (for example, hydrogenated styrene-diene copolymer, etc.), and the like. The pour-point depressant includes, for example, polymethacrylate and the like.

The content of viscosity index improver is generally 0.5 to 30% by mass, preferably 1 to 20% by mass, on the basis of the total amount of the lubricating oil composition.

As examples of the defoaming agent, liquid silicone is suitable, and methylsilicone, fluorosilicone, and polyacrylate are usable.

The content of defoaming agent is preferably 0.0005 to 0.01% by mass on a basis of the total amount of the lubricating oil composition.

The lubricating oil composition for internal combustion engines of the present invention has an excellent low-temperature fluidity, a low evaporativity, and a good oxidation stability. The kinematic viscosity at 40° C. of the composition is generally around 10 to 200 $mm^2/s$, and preferably 1 to 100 $mm^2/s$. The kinematic viscosity at 100° C. is generally around 3 to 20 $mm^2/s$, and preferably 5 to 15 $mm^2/s$. The viscosity index is generally 120 or more, preferably 140 or more, and more preferably 150 or more.

EXAMPLES

The present invention will be further explained in detail with reference to Examples below, but the invention is not limited to these examples.

The properties and performances of the lubricating oil composition obtained in each example were determined by the following methods.

(1) Kinematic Viscosity

Kinematic viscosities at 40° C. and 100° C. are measured in accordance with JIS K2283.

(2) Viscosity Index

Viscosity index is measured in accordance with JIS K2283.

(3) Acid Value

Acid value is measured in accordance with JIS K2501.

(4) Total Base Number

Total base number is measured in accordance with JIS K2501 (hydrochloric acid method).

(5) CCS Viscosity

Viscosity at −35° C. is measured in accordance with JIS K2010.

(6) NOACK Evaporation Test

NOACK evaporation loss is measured in accordance with the Japan Petroleum Institute Standard PI-5S-41-93 under the conditions of 250° C. and 1 hr.

(7) ISOT Oxidation Stability Test

ISOT oxidation stability is measured in accordance with the oxidation stability test for lubricating oil compositions for internal combustion engines as described in JIS K2514 under the conditions of 175° C. and 72 hr.

Production Example 1

Production of Hydrogenated α-Olefin Oligomer having 30 Carbon Atoms (a) Oligomerization of Decene A 5-L three-neck flask was charged with 4 L (21.4 mol) of decene monomer (Linealene 10: trade name, manufactured by Idemitsu Kosan Co., Ltd.) under inert gas stream, and here were added biscyclopentadienylzirconium dichloride (the mass of complex was 1168 mg: 4 mmol) dissolved in toluene and methylaluminoxane (40 mmol in terms of Al) dissolved in toluene. The resultant mixture was stirred at 40° C. for 20 hr, and then 20 ml of methanol was added to terminate the oligomerization. The reaction mixture was taken out of the autoclave, and here was added 4 L of aqueous solution containing 5 mol/L of sodium hydroxide. After the mixture was forcefully stirred for 4 hr, it was allowed to separate into two phases. The upper organic phase was collected, and unreacted decene and decene isomers formed as byproducts were removed by stripping.

(b) Hydrogenation of Decene Oligomer

An autoclave with an inner volume of 5 L was charged with 3 L of the decene oligomer produced in (a) in nitrogen gas stream, and here were added trisacetylacetonatocobalt (catalyst weight: 3.0 g) dissolved in toluene and triisobutylaluminum (30 mmol) diluted with toluene. After the reaction system was purged with hydrogen twice, it was heated and kept at 80° C. under a hydrogen pressure of 0.9 MPa. Hydrogenation immediately proceeded exothermically. When four hours passed after the reaction started, the temperature was lowered to terminate the reaction. The pressure was released, the reaction mixture was taken out of the autoclave, and the fraction of boiling at 240 to 270° C. under 530 Pa (desired compound) was isolated by simple distillation.

Examples 1 to 4 and Comparative Example 1

The base oils and additives shown in Table 1 were mixed in the ratios shown in Table 1 to prepare the lubricating oil compositions for internal combustion engines. The properties and performances of the lubricating oil compositions were determined. The results are shown in Table 1.

TABLE 1

| | | | | Example | | | | Comparative Example |
|---|---|---|---|---|---|---|---|---|
| | | | | 1 | 2 | 3 | 4 | 1 |
| Component ratios in lubricating oil compositions (% by mass) | Base oil | PAO-1[1)] | | 48.4 | 43.4 | 38.4 | 28.4 | 28.4 |
| | | PAO-2[2)] | | — | — | — | — | 40 |
| | | mPAO[3)] | | 20 | 25 | 30 | 40 | — |
| | | dibasic acid ester[4)] | | 15 | 15 | 15 | 15 | 15 |
| | | mPAO content in base oil | | (24) | (30) | (36) | (48) | 0 |
| | Viscosity index improver OCP[5)] | | | 4 | 4 | 4 | 4 | 4 |
| | API, SL engine oil package | | | 12.6 | 12.6 | 12.6 | 12.6 | 12.6 |
| Properties of lubricating oil composition | Kinematic viscosity ($mm^2/s$) | | 40° C. | 49.03 | 46.55 | 44.64 | 41.58 | 46.79 |
| | | | 100° C. | 9.053 | 8.660 | 8.407 | 8.109 | 8.665 |
| | Viscosity index | | | 168 | 167 | 167 | 173 | 166 |
| | CCS viscosity (−35° C.) (mPa · s) | | | 5150 | 4650 | 4300 | 3600 | 4850 |
| | Acid value (mgKOH/g) | | | 1.95 | 1.93 | 1.97 | 2.06 | 1.98 |
| | Total base number mgKOH/g) | | | 5.64 | 5.69 | 5.73 | 5.69 | 5.75 |
| Performances of lubricating oil composition | NOACK (250° C., 1 hr) (% by mass) | | | 7.6 | 7.7 | 7.8 | 8.1 | 8.7 |
| | ISOT (175° C., 72 hr) | Kinematic viscosity ($mm^2/s$) | 40° C. | | 48.78 | | | 52.64 |
| | | | 100° C. | | 8.866 | | | 9.176 |
| | | Viscosity index | | | 292 | | | 292 |
| | | Kinematic viscosity ratio | 40° C. | | 1.05 | | | 1.12 |
| | | | 100° C. | | 1.02 | | | 1.06 |
| | | Acid value (mgKOH/g) | | | 3.95 | | | 4.45 |
| | | Change in acid value (mgKOH/g) | | | 2.02 | | | 2.47 |
| | | Total base number (mgKOH/g) | | | 0.22 | | | 0.01 |
| | | Decrease in total base number (mgKOH/g) | | | 5.47 | | | 5.74 |

[Note]

1) α-Olefin oligomer ("DURASYN-166": trade name, manufactured by BP Chemicals Corp.) which is 1-decene oligomer obtained by conventional methods having a kinematic viscosity at 40° C. of 30 $mm^2/s$ 2) α-Olefin oligomer ("DURASYN-164": trade name, manufactured by BP Chemicals Corp.) which is 1-decene oligomer obtained by conventional methods having a kinematic viscosity at 40° C. of 17 $mm^2/s$ 3) Hydrogenated 1-decene trimer obtained in Production example 1 using a metallocene catalyst having a kinematic viscosity at 40° C. of 14 $mm^2/s$ 4) Ditridecyl adipate 5) Ethylene-propylene copolymer having a weight average molecular weight of 210,000.

Industrial Applicability

The lubricating oil composition for internal combustion engines of the present invention has an excellent low-temperature fluidity, a low evaporativity, and a good oxidation stability. The lubricating oil composition is a fuel-saving engine oil, reducing its consumption as well. Therefore, it is also effectively used as a lubricating oil composition for internal combustion engines which saves natural resources and fuel and hence contributes to countermeasures against global warming.

What is claimed is:

1. A lubricating oil composition comprising a first base oil and a second base oil;

wherein the first base oil comprises at least one component selected from the group consisting of (A) an α-olefin oligomer having 16 to 40 carbon atoms obtained by a process comprising oligomerizing an α-olefin, having 2 to 20 carbon atoms, in the presence of a metallocene catalyst;

(B) a hydrogenated derivative of the α-olefin oligomer (A);

(E) an α-olefin oligomer having 16 to 40 carbon atoms obtained by a process comprising adding, in the presence of an acid catalyst, an α-olefin having 6 to 8 carbon atoms to a α-olefin dimer comprising a vinylidene bond obtained by a process comprising dimerizing an α-olefin having 2 to 20 carbon atoms, in the presence of a metallocene catalyst; and (F) a hydrogenated derivative of α-olefin oligomer (E); and wherein the first base oil is present in the composition in an amount of from 20 to 40 mass %, and the second base oil is present in the composition in an amount of from 43.4 to 63.4 mass %.

2. The lubricating oil composition according to claim 1, wherein the α-olefin oligomer of the component (A) comprises a structure represented by formula (I):

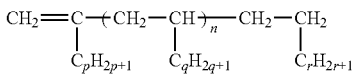

(I)

wherein p, q, and r represent each independently an integer of 0 to 18; n represents an integer of 0 to 8; when n is 2 or more, the values of q in the individual repeating units may be the same or different; and the value of p+n×(2+q)+r is 12 to 36.

3. The lubricating oil composition according to claim 1, wherein the hydrogenated α-olefin oligomer of the component (B) comprises a structure represented by formula (II):

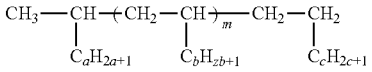

(II)

wherein a, b, and c represent each independently an integer of 0 to 18; m represents an integer of 0 to 8; when m is 2 or more, the values of a in the individual repeating units may be the same or different; and the value of a+m×(2+b)+c is 12 to 36.

4. The lubricating oil composition according to claim 1, wherein the base oil comprises 10 to 100% by mass of at least one component selected from the group of components consisting of (A) (B), (E), and (F).

5. The lubricating oil composition according to claim 1, comprising at least one additive selected from the group consisting of an extreme-pressure additive, an oiliness improver, an antioxidant, a rust inhibitor, a metal deactivator, a detergent-dispersant, a viscosity index improver, a pour-point depressant, and a defoaming agent.

6. The lubricating oil composition according to claim 1, wherein the second base oil comprises a mineral base oil.

7. The lubricating oil composition according to claim 6, wherein the mineral base oil comprises a base oil obtained by a process comprising distilling crude oil under atmospheric pressure to obtain a residue, distilling the residue under vacuum to collect a lubricating oil fraction, and refining the lubricating oil fraction by one or more processes of solvent deasphalting, solvent extraction, hydrocracking, solvent dewaxing, and hydrotreating.

8. The lubricating oil composition according to claim 1, wherein the second base oil comprises a synthetic base oil.

9. The lubricating oil composition according to claim 8, wherein the synthetic base oil comprises at least one of an α-olefin oligomer, a hydrogenated derivative thereof, di-2-ethylhexyl adipate, di-2-ethylhexyl cebacate, trimethylolpropane caprate, pentaerythritol 2-ethylhexanoate, alkylbenzene, alkylnaphthalene, or a polyalkylene glycol, or mixtures thereof.

10. The lubricating oil composition according to claim 6, wherein the mineral base oil comprises a base oil obtained by a process comprising isomerizating mineral oil wax or wax produced by Fischer-Tropsch process.

11. The lubricating oil composition according to claim 6, wherein the mineral base oil has a viscosity index of 90 or more.

12. The lubricating oil composition according to claim 6, wherein the mineral base oil has a viscosity index of 110 or more.

13. The lubricating oil composition according to claim 1, wherein the second base oil is present in the composition in an amount of 75% by mass or less.

14. The lubricating oil composition according to claim 6, wherein the mineral base oil has an aromatic content of 3% $C_A$ or less.

15. The lubricating oil composition according to claim 6, wherein the mineral base oil has a sulfur content of 100 ppm by mass or less.

16. The lubricating oil composition according to claim 6, wherein the second base oil further comprises a synthetic base oil.

17. The lubricating oil composition according to claim 1, wherein a metallocene poly-olefin content in the first base oil is from 24 to 48 mass %.

18. The lubricating oil composition according to claim 1, wherein the first base oil is present in the composition in an amount of from 20 to 30 mass %, and the second base oil is present in the composition in an amount of from 28.4 to 38.4 mass %.

19. The lubricating oil composition according to claim 1, wherein a metallocene poly-olefin content in the first base oil is from 24 to 36 mass %.

* * * * *